US008640869B2

(12) United States Patent
Schütz

(10) Patent No.: US 8,640,869 B2
(45) Date of Patent: Feb. 4, 2014

(54) TRANSPORT AND STORAGE CONTAINER FOR LIQUIDS

(75) Inventor: Udo Schütz, Selters (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 13/224,167

(22) Filed: Sep. 1, 2011

(65) Prior Publication Data

US 2012/0055830 A1 Mar. 8, 2012

(30) Foreign Application Priority Data

Sep. 6, 2010 (DE) ..... 10 2010 040 270

(51) Int. Cl.
*B65D 19/00* (2006.01)
*B65D 1/34* (2006.01)

(52) U.S. Cl.
USPC ..... 206/386; 220/9.4; 220/571

(58) Field of Classification Search
USPC ..... 206/386; 220/1.5, 9.1–9.4, 23.91, 571
See application file for complete search history.

(56) References Cited

U.S. PATENT DOCUMENTS

| | | | | |
|---|---|---|---|---|
| 5,316,174 | A * | 5/1994 | Schutz | 220/571 |
| 5,738,240 | A * | 4/1998 | Vavra et al. | 220/1.5 |
| 5,823,382 | A * | 10/1998 | Van Giezen et al. | 220/571 |
| 6,668,735 | B2 | 12/2003 | Cassina | |
| 6,719,162 | B2 * | 4/2004 | Przytulla | 220/23.91 |
| 6,719,164 | B2 * | 4/2004 | Maschio | 220/571 |
| 7,108,133 | B2 * | 9/2006 | Przytulla | 206/386 |
| 7,648,040 | B2 * | 1/2010 | Przytulla | 220/9.1 |
| 7,866,501 | B2 | 1/2011 | Schütz | |
| 7,908,980 | B2 | 3/2011 | Schmidt et al. | |
| 2002/0178974 | A1 | 12/2002 | Schutz | |
| 2003/0024935 | A1 * | 2/2003 | Kind | 220/571 |
| 2004/0149610 | A1 * | 8/2004 | Schutz | 206/386 |
| 2005/0092639 | A1 * | 5/2005 | Schutz | 206/386 |
| 2005/0196252 | A1 | 9/2005 | Schutz | |

FOREIGN PATENT DOCUMENTS

| | | |
|---|---|---|
| DE | 202004003020 A | 4/2004 |
| DE | 60024589 | 6/2006 |
| DE | 202006001222 | 5/2007 |
| EP | 0498984 | 8/1992 |
| JP | H05-042988 | 2/1993 |
| JP | 2001088831 | 4/2001 |
| JP | 2005246481 | 9/2005 |

* cited by examiner

*Primary Examiner* — Bryon Gehman
(74) *Attorney, Agent, or Firm* — McGlew and Tuttle, P.C.

(57) ABSTRACT

A transport and storage container for liquids, with a plastic inner container, an outer jacket, as well as a pedestal resembling a pallet, which is equipped to be handled by stacker trucks, stacker cranes, or similar transport devices. The pedestal exhibits a floor for bracing the inner container and a base frame with support feet. The floor exhibits a supporting surface for the inner container and a bearing edge, which is separated from the supporting surface by a floor barrier, and arranged between a lower edge of the outer jacket and the base frame. The lower edge of the outer jacket is frictionally connected to the base frame at least at one junction by a bonding device that acts on the base frame via the bearing edge. The floor barrier exhibits a lowered barrier in the area of the junction.

19 Claims, 4 Drawing Sheets

Fig. 2
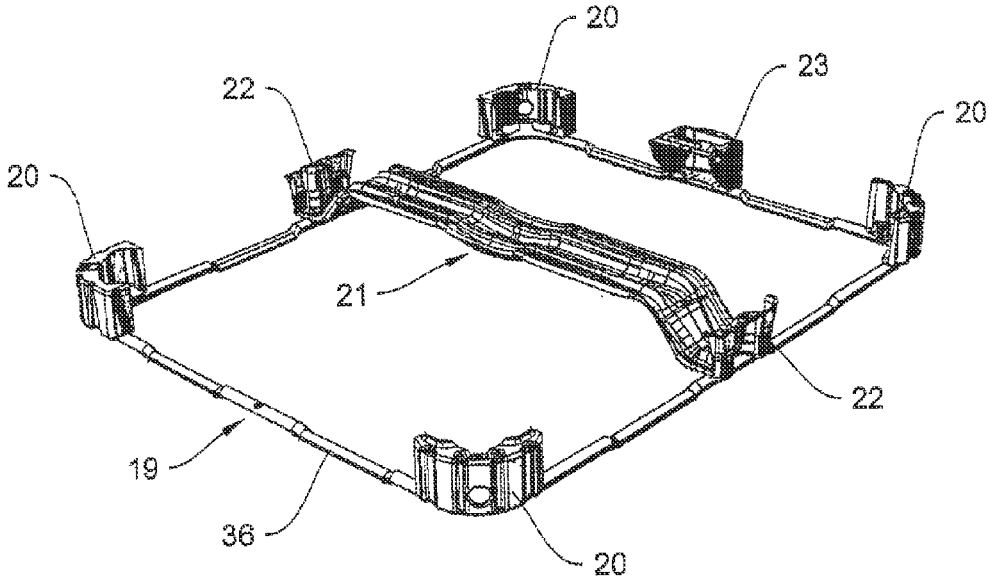
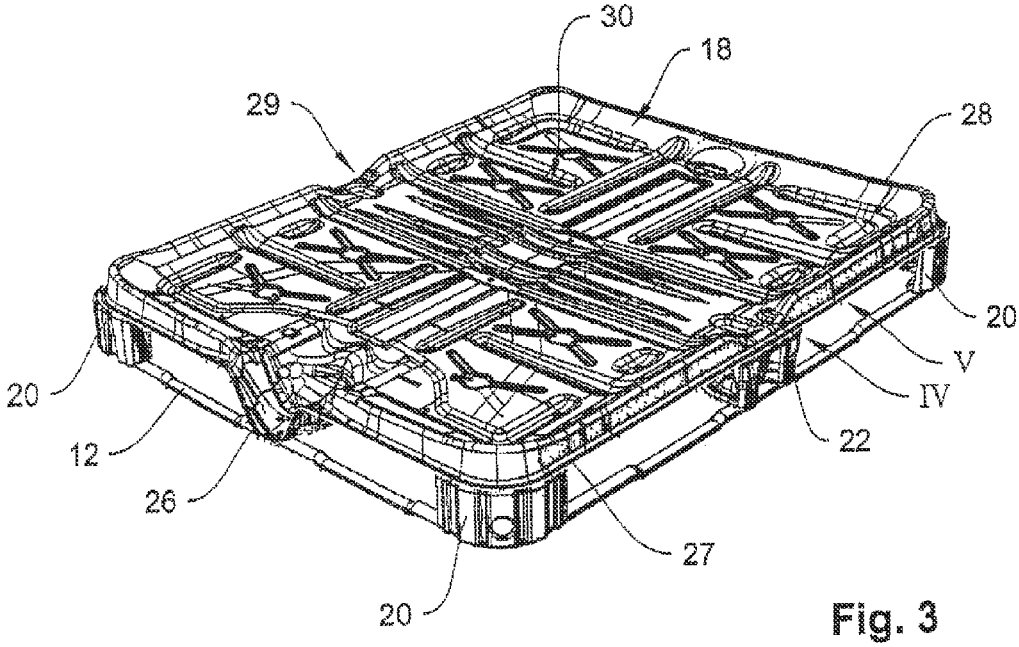
Fig. 3

Fig. 4
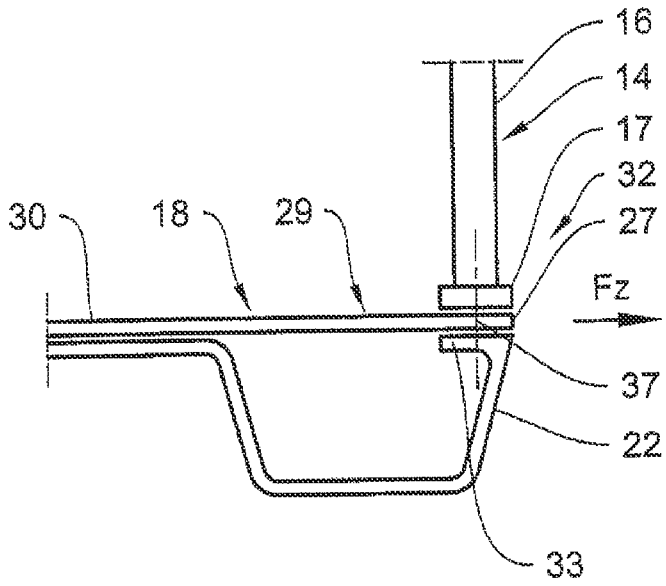
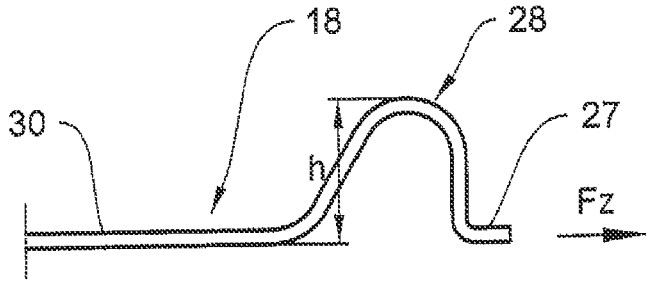
Fig. 5

TRANSPORT AND STORAGE CONTAINER FOR LIQUIDS

The present application claims priority of DE 10 2010 040 270.2-22, filed Sep. 6, 2010, the priority of this application is hereby claimed and this application is incorporated herein by reference.

BACKGROUND OF THE INVENTION

The invention relates to a transport and storage container for liquids.

In addition to a plastic inner container, known transport and storage containers for liquids encompass an outer jacket, in particular made of a metal grid frame or sheet steel, as well as a pedestal resembling a pallet, which is equipped to be handled by means of stacker trucks, stacker cranes, or similar transport means. The pedestal exhibits a floor for bracing the inner container and a base frame with support feet. The floor exhibits a supporting surface for the inner container, and a bearing edge, which is separated from the supporting surface by a floor barrier, and arranged between a lower edge of the outer jacket and the base frame. The lower edge of the outer jacket is frictionally connected to the base frame at least at one junction by means of a bonding device that acts on the base frame via the bearing edge.

Therefore, the floor on the base frame in known transport and storage containers forms the lower boundary of a receiving area for the plastic inner container. The outer jacket forms the lateral boundaries and upper boundary.

In other words, the combination of floor on the base frame and outer jacket thus forms an enveloping structure for the plastic inner containers, on which the inner container can be completely or partially accommodated and remains positioned, especially in a filled state. When a force acts on the enveloping structure, for example as the result of an elevated force in the inner container or surge fluctuations of the filler during transport, the mechanical stress may expose the enveloping structure to an intensified load or deformation.

In order to reduce the risk of damage to the inner container by an excessively loaded or deformed enveloping structure, it is desirable to give the enveloping structure as stiff a design as possible, thereby keeping the corresponding loads or deformations of the enveloping structure as small as possible. On the other hand, of course, the goal is to at least position the inner container inside the enveloping structure, for which purpose the floor barrier framing the supporting surface of the floor is designed in particular. However, at least from a mechanical standpoint, this floor barrier creates a soft spot that reduces the stiffness of the floor, so that the floor barrier has a negative effect in terms of establishing the stiffest possible enveloping structure.

SUMMARY OF THE INVENTION

Therefore, the object of the invention is to propose a transport and storage container for liquids that enables the desired positioning arrangement of the inner container with a floor barrier framing the supporting surface of the floor on the one hand, and exhibits the stiffest possible enveloping structure on the other.

According to the invention, the floor of the transport and storage container provided with a floor barrier that separates the supporting surface from a bearing edge exhibits a reduced barrier height, meaning a lowered barrier, in the area of at least one junction where a force is introduced from the outer jacket into the floor. This lowered barrier is formed in the junction area so as to otherwise not impair the desired positioning effect of the barrier, and causes the floor in direct proximity to the junction to be stiffer than in the remaining area. As a result of this elevated stiffness, the floor in the junction area can absorb a comparatively elevated tensile stress without being associated with a deformation of the floor, and hence a corresponding deformation of the enveloping structure.

In order to achieve this effect enabled by the invention, it is especially advantageous that the barrier height be reduced to the level of the supporting surface. However, the instruction according to the invention can basically be used to already achieve an advantageous elevation in stiffness in the junction area via a relatively slight lowering or reduction of the barrier height.

It is especially advantageous for the barrier to be lowered continuously in the form of a ramp from one barrier crest toward the supporting surface, thereby avoiding abrupt transitions in cross section, and hence resulting in only relatively small directional changes in flux. In particular, this forestalls the formation of deformation cracks in the junction area.

If the lowered barrier is formed in at least two opposing areas of the bearing edge, the stiffening effect can be enhanced even further.

It is also especially advantageous that the lowered barrier be formed near a support foot of the base frame, thereby even further enhancing the floor-stiffening effect of the support foot at this location.

If the lowered barrier is formed in the area of a rear, middle support foot arranged opposite a lowered floor for an outlet of the inner container, a stiffened tensile stress axis can be formed acting in conjunction with the lowered barrier in the area of a rear, middle support foot.

In an especially preferred embodiment of the transport and storage container, the base frame exhibits a stiffening plate that transversely joins two opposing support feet, wherein the lowered barrier is formed in the area of the two opposing support feet, so that the lowered barriers in the area of the support feet further increase the floor-stiffening effect of the stiffening plate.

An embodiment of the invention will be explained in greater detail below based on a drawing.

BRIEF DESCRIPTION OF THE DRAWING

In the drawings:

FIG. 2: is a perspective view of a base frame with support feet;

FIG. 3: is a perspective view of the floor arranged on the base frame according to FIG. 2;

FIG. 4: is a partial sectional view of the floor in area IV of FIG. 3;

FIG. 5: is a partial sectional view of the floor in area V of FIG. 3;

DETAILED DESCRIPTION OF THE INVENTION

Figure 1:
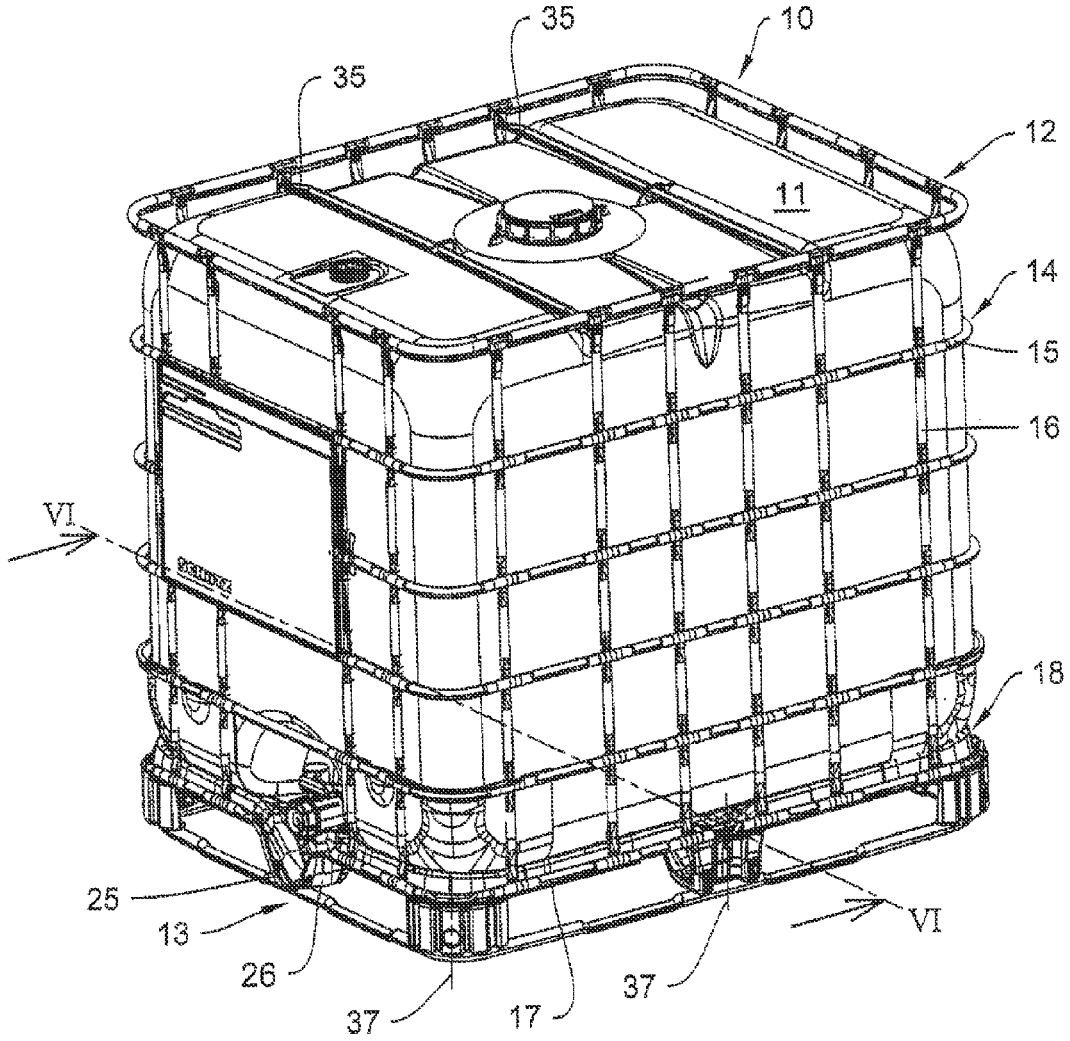
FIG. 1: is a perspective view of the transport and storage container.

FIG. 1 shows a transport and storage container 10 with a plastic inner container 11, which is arranged in an enveloping structure 12 that shields the inner container 11 against mechanical loads. The enveloping structure 12 of the transport and storage container 10 exhibits an outer jacket 14 that is arranged on a pedestal 13 resembling a pallet, and in the present case consists of a plurality of horizontal rods 15 and vertical rods 16 that crisscross each other to form a lattice structure.

The outer jacket 14 sits on a floor 18 of the pedestal 13 with a lower edge 17 in this instance comprised of a lower horizontal rod 15. In the present case, additional traversing rods 35 are provided at the upper edge of the outer jacket 14 for enhanced stiffening.

As evident from a combined review of FIGS. 2 and 3, the floor 18 shown on FIG. 3 is arranged on a base frame 19 depicted in particular on FIG. 2. The base frame 19 exhibits a continuous frame tubing 36, which has four support feet 20 provided in the frame corners, support feet 22 formed by end regions of a stiffening plate 21, and a rear, middle support foot 23, which as may be gleaned in conjunction with FIG. 1 lies opposite a lowered floor 25, which comprises a middle, front support foot 26.

As evident from a combined review of FIGS. 2 and 3, the floor 18 rests on the support feet 20, 22 and 23 with a bearing edge 27, and exhibits a floor barrier 28 that runs parallel to the bearing edge 27, separates a supporting surface 30 of the floor 18 for supporting the inner container 11 from the bearing edge 27, and is provided with a respective lowered barrier 29 in the area of the middle support feet 22.

FIG. 4 presents a highly simplified diagrammatic view of a partial cross section of the floor 18 in the area of a lowered barrier 29. By comparison, FIG. 5 depicts a partial cross section of the floor 18 in the area of the floor barrier 28. As shown on FIG. 4, the floor 18 in the area of the lowered barrier 29 sits with the bearing edge 27 on a connecting web 33 of the support foot 22. The bearing edge 27 is accommodated between the lower edge 17 of the outer jacket 14 and connecting web 33, wherein a connecting pin 37 joins the lower edge 17 and floor 18 with the connecting web 33 of the support foot 22 to establish a junction 32 by frictional connection. As a result of the lowered barrier 29, the transition from the bearing edge 27 to the supporting surface 30 in the depicted exemplary embodiment is substantially even.

The bearing edge 27 shown on FIG. 5 is also situated in a plane with the supporting surface 30 of the floor 18. However, the floor barrier 28 between the bearing edge 27 and supporting surface 30 forms a wave in the floor 18, so that the floor 18 exhibits a comparatively reduced stiffness in the area of the floor barrier 28 when exposed to a tensile force $F_7$ depicted on FIGS. 4 and 5. As a result of the floor barrier 28 or the wave generated by the floor barrier 28 in the floor 18, the floor 18 does not stretch when exposed to a tensile load given a tensile load measuring less than the yield strength of the material used for the floor 18 in the case of the lowered barrier 29 depicted on FIG. 4, while the floor 18 does stretch in the direction of tensile force $F_7$ in the area of the floor barrier 28 shown on FIG. 5, to an extent essentially corresponding to the height h of the floor barrier 28. As a consequence, it must be stated that the floor 18 is stiffer in the area of the lowered barrier 29 shown on FIG. 4 than in the area of the floor barrier 28 shown on FIG. 5 given a tensile load acting in the plane of the floor 18.

As may also be gleaned from FIG. 1, the bearing edge 27 of the floor 18 is situated between the support feet 20, 22 and 23 and the lower edge 17 of the outer jacket 14 in such a way that the floor 18 is simultaneously joined to the lower edge 17 of the outer jacket and to the base frame 19 at the junctions 32 respectively defined by the position of the support feet 20, 22 and 23. To this end, the junctions 32 are provided with connecting pins 37, as already mentioned previously.

Figure 6:
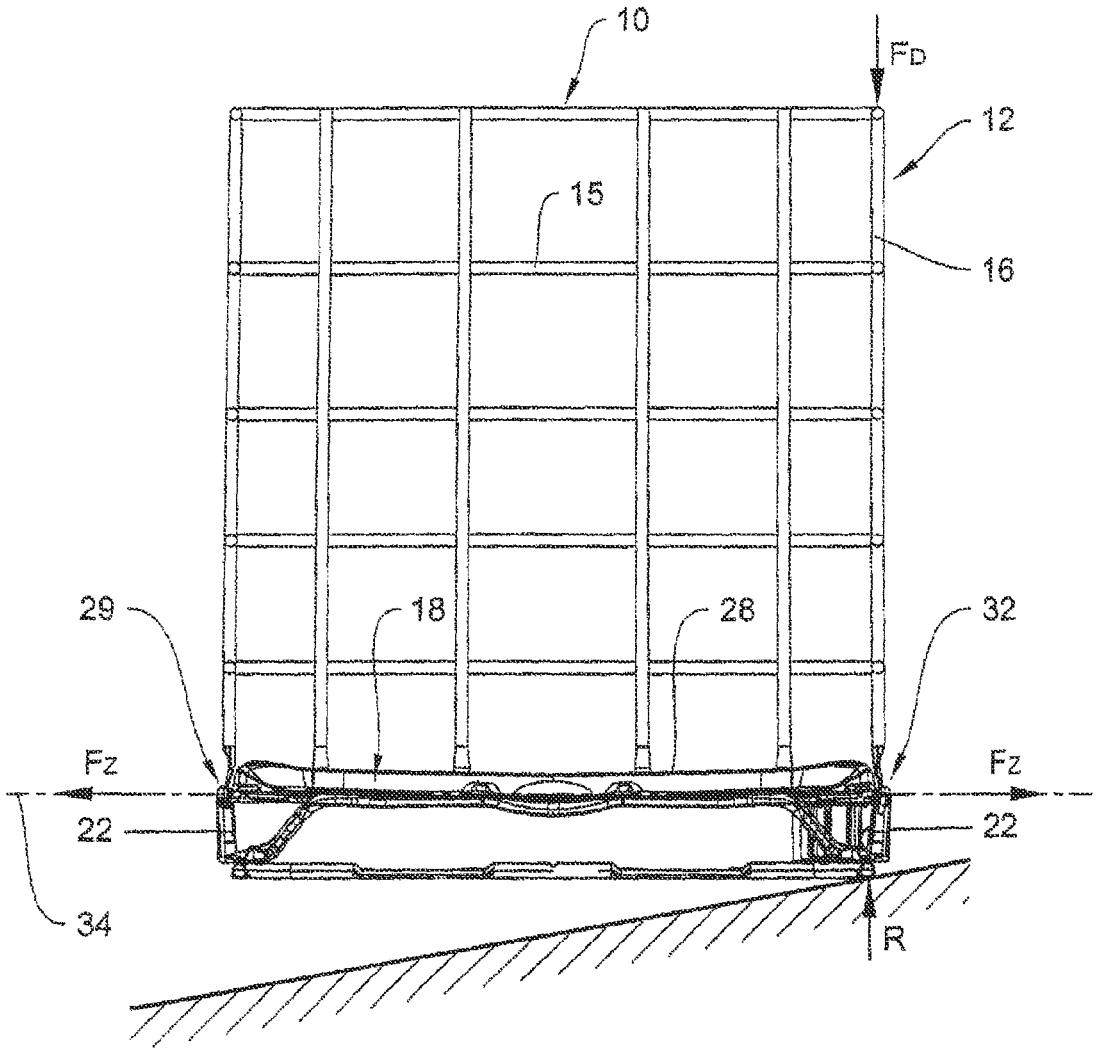
FIG. 6: is a sectional view of the transport and storage container shown on FIG. 1 along intersecting line VI-VI on FIG. 1, with the inner container not depicted.

In a sectional view of the transport and storage container 10 according to intersecting line VI-VI on FIG. 1, FIG. 6 presents an example for a load of the kind that can be encountered when the transport and storage container 10 is placed unevenly on a subfloor because the transport and storage container 10 is tilted relative to the floor. In the exemplary load shown on FIG. 6, the longitudinal side of the transport and storage container 10 at first rests on the subfloor while being put down. As a consequence, the enveloping structure 12 becomes jammed, or at least exposed to a compressive load, so that a compressive force $F_P$ prescribed corresponding reaction force $F_R$ acts on the junction 32 in the area of the junction 32, and the geometry of the enveloping structure 12 induces a tensile force $F_Z$ in the floor 18, which acts along a loading or tensile axis 34 formed between the middle support feet 22.

In the exemplary load depicted on FIG. 6, the floor 18 is effectively stiffened in the direction of the tensile axis 34 defined by the tensile stress on the one hand by the stiffening plate 21, which is situated under the floor 18 and whose end areas form the support feet 22, and on the other by virtue of the fact that the lowered barriers 29 are formed in the floor barrier 28 in the area of the junctions 32. The fact that the floor 18 exhibits a reduced flexibility in the area of the lowered barriers 29 by comparison to the floor barrier 28 formed between the junctions 32 here stiffens the floor 18.

The invention claimed is:

1. A transport and storage container for liquids, the container comprising:

a plastic inner container;

an outer jacket having a lower edge;

a base frame with support feet;

a floor for bracing the inner container, the floor having a supporting surface for supporting the inner container, a floor barrier and an outer bearing edge separated from the supporting surface by the floor barrier, the floor barrier extending a height distance from a level of the supporting surface in a direction away from the base frame, the outer bearing edge being arranged between a lower edge of the outer jacket and the base frame, the base frame and the floor cooperating to form a pedestal resembling a pallet; and a bonding device acting on the base frame via the outer bearing edge and frictionally connecting the lower edge of the outer jacket to the base frame at a junction of the lower edge, the outer bearing edge and the base frame, at which junction the lower edge contacts the outer bearing edge and the outer bearing edge contacts the base frame, the floor barrier having a lowered barrier portion, with a lesser height in the direction away from the base frame, in an area of the junction.

2. The container according to claim 1, wherein the lowered barrier portion is continuously formed as a ramp.

3. The container according to claim 1, wherein the lowered barrier portion is formed in at least two opposing areas of the outer bearing edge.

4. The container according to claim 1, wherein the lowered barrier portion is formed in the area of one of the support feet.

5. The container according to claim 1, wherein the lowered barrier portion is formed in an area of a rear, middle support foot that lies opposite a lowered floor for an outlet of the inner container.

6. The container according to claim 1, wherein:

two of the support feet are positioned opposing each other to form two opposing support feet;

the base frame has a stiffening plate that transversely joins the two opposing support feet; and the lowered barrier portion is formed in an area of each of the two opposing support feet.

7. A transport and storage container for liquids, the container comprising:

a plastic inner container;

an outer jacket having a lower edge;

a base frame with support feet;

a floor having a supporting surface for supporting the inner container, a floor barrier extending from a level of the supporting surface in a direction away from the base frame and an outer bearing edge, the floor barrier being arranged between the supporting surface and the outer bearing edge, the outer bearing edge being arranged between a lower edge of the outer jacket and the base frame; and a connection area for a connection device acting on the base frame via the outer bearing edge and connecting the lower edge of the outer jacket to the base frame at the connection area, at which the lower edge contacts the outer bearing edge and the outer bearing edge contacts the base frame, the floor barrier having a portion of lesser extent in the connection area or adjacent to the connection area, the portion of lesser extent extending in the direction away from the base frame to a lesser extent than the floor barrier in a region outside of the connection area or in a region not adjacent to the connection area.

8. The container according to claim 7, wherein the floor barrier having the lesser extent is a floor barrier ramp.

9. The container according to claim 7, wherein the floor barrier has another portion of lesser extent, the another portion of lesser extent being formed at an area of the outer bearing edge opposite to the portion of lesser extent.

10. The container according to claim 7, wherein the portion of lesser extent is formed in the area of one of the support feet.

11. The container according to claim 7, wherein the portion of lesser extent is formed in an area of a rear, middle support foot that lies opposite a lowered floor for an outlet of the inner container.

12. The container according to claim 7, wherein:

two of the support feet are positioned opposing each other to form two opposing support feet;

the base frame has a stiffening plate that transversely joins the two opposing support feet; and the lowered barrier portion is formed in an area of each of the two opposing support feet.

13. A transport and storage container for liquids, the container comprising:

a plastic inner container;

an outer jacket having a lower edge;

a base frame with support feet;

a floor having a supporting surface for supporting the inner container, a floor barrier having a height relative to a level of the supporting surface in a direction away from the base frame, and an outer bearing edge, the floor barrier being positioned between the supporting surface and the outer bearing edge, the outer bearing edge being arranged between a lower edge of the outer jacket and the base frame; and a connection area of the lower edge of the outer jacket to the base frame, the lower edge contacting the outer bearing edge and the outer bearing edge contacting the base frame at the connection area, the connection area having a connection area width, the floor barrier having a reduced height along the width of the connection area or having the reduced height directly adjacent to the width of the connection area.

14. The container according to claim 13, further comprising a connection device acting on the base frame via the outer bearing edge and connecting the lower edge of the outer jacket to the base frame at the connection area.

15. The container according to claim 14, wherein the reduced height floor barrier is a floor barrier ramp.

16. The container according to claim 14, wherein the floor barrier also has a reduced height opposite the reduced height along the width of the connection area.

17. The container according to claim 14, wherein the reduced height along the width of the connection area is in the area of one of the support feet.

18. The container according to claim 14, wherein the reduced height along the width of the connection area is formed in an area of a rear, middle support foot that lies opposite a lowered floor for an outlet of the inner container.

19. The container according to claim 14, wherein:

two of the support feet are positioned opposing each other to form two opposing support feet;

the base frame has a stiffening plate that transversely joins the two opposing support feet; and the barrier portion of reduced height along the width of the connection area is formed in an area of each of the two opposing support feet.

* * * * *